US011203867B2

(12) United States Patent
Ferland

(10) Patent No.: US 11,203,867 B2
(45) Date of Patent: Dec. 21, 2021

(54) STRUCTURE FOR HIDING AND PROTECTING FROM DAMAGE HVAC AND OTHER ROOFTOP MECHANICAL EQUIPMENT

(71) Applicant: Eric Ferland, Quebec (CA)

(72) Inventor: Eric Ferland, Quebec (CA)

( * ) Notice: Subject to any disclaimer, the term of this patent is extended or adjusted under 35 U.S.C. 154(b) by 0 days.

(21) Appl. No.: 16/884,200

(22) Filed: May 27, 2020

(65) Prior Publication Data

US 2020/0392728 A1 Dec. 17, 2020

Related U.S. Application Data

(63) Continuation-in-part of application No. 16/265,998, filed on Feb. 2, 2019, now abandoned.

(51) Int. Cl.

| | |
|---|---|
| ***E04B 7/18*** | (2006.01) |
| ***F24F 13/20*** | (2006.01) |
| ***E04B 2/58*** | (2006.01) |

(52) U.S. Cl.

CPC ..... *E04B 7/18* (2013.01); *E04B 2/58* (2013.01); *F24F 13/20* (2013.01); *F24F 2221/16* (2013.01)

(58) Field of Classification Search

CPC ..... F24F 2221/16; E04B 7/18; E04B 2/58; E04D 13/00

See application file for complete search history.

(56) References Cited

U.S. PATENT DOCUMENTS

| | | | | |
|---|---|---|---|---|
| 3,222,841 | A | 12/1965 | Lipof | |
| 3,708,153 | A | 1/1973 | Triem | |
| 4,860,918 | A | 8/1989 | Wuyten et al. | |
| 5,129,239 | A | 7/1992 | Thurman | |
| 5,664,384 | A | 9/1997 | Cullinan | |
| 5,848,507 | A | 12/1998 | Bozich | |
| 5,862,637 | A | 1/1999 | Bruce | |
| 6,138,993 | A | 10/2000 | Mitchell, Jr. et al. | |
| 6,205,719 | B1 | 3/2001 | Bruce | |
| 6,478,166 | B2 * | 11/2002 | Hung | H05K 7/183 211/175 |
| 6,758,015 | B2 | 7/2004 | Clasen et al. | |
| 6,782,668 | B2 | 8/2004 | Bruce | |
| 7,059,088 | B2 | 6/2006 | Lattanzio | |
| 7,310,920 | B2 | 12/2007 | Hovey, Jr. | |
| 7,757,510 | B2 | 7/2010 | Rosete et al. | |

(Continued)

FOREIGN PATENT DOCUMENTS

CA 3023133 A1 * 5/2019 ..... A01G 7/045

*Primary Examiner* — Babajide A Demuren

(57) ABSTRACT

A structure for hiding rooftop equipment has a plurality of pre-cut, adjustable metallic frame and support members essentially consisting of vertical support members, horizontal frame members, top frame members, and bottom retaining members, wherein the plurality of pre-cut, adjustable metallic frame and support members are configured to surround the rooftop equipment while providing a passageway enabling a user to provide maintenance on the rooftop equipment, and, each bottom retaining member is comprised of a base portion, a reinforcement member, and a connecting member wherein the connecting member is mechanically fastened either to an existing roof curb forming part of the building the structure is on or to a base portion of the rooftop equipment.

6 Claims, 18 Drawing Sheets

(56) References Cited

U.S. PATENT DOCUMENTS

| | | | | |
|---|---|---|---|---|
| 8,528,875 | B2 * | 9/2013 | Wilson, Jr. | F24F 1/60<br>248/188.1 |
| 8,800,243 | B2 * | 8/2014 | Reid | E04H 1/125<br>52/36.1 |
| 2006/0117668 | A1 * | 6/2006 | Forbis, Sr. | E04D 13/00<br>52/3 |
| 2008/0083239 | A1 * | 4/2008 | Meyer | F24F 13/20<br>62/259.1 |
| 2009/0014044 | A1 * | 1/2009 | Hartman | E04B 1/3445<br>135/143 |
| 2009/0019789 | A1 | 1/2009 | Gephart et al. | |
| 2017/0121966 | A1 * | 5/2017 | Jiang | E04B 1/947 |

* cited by examiner

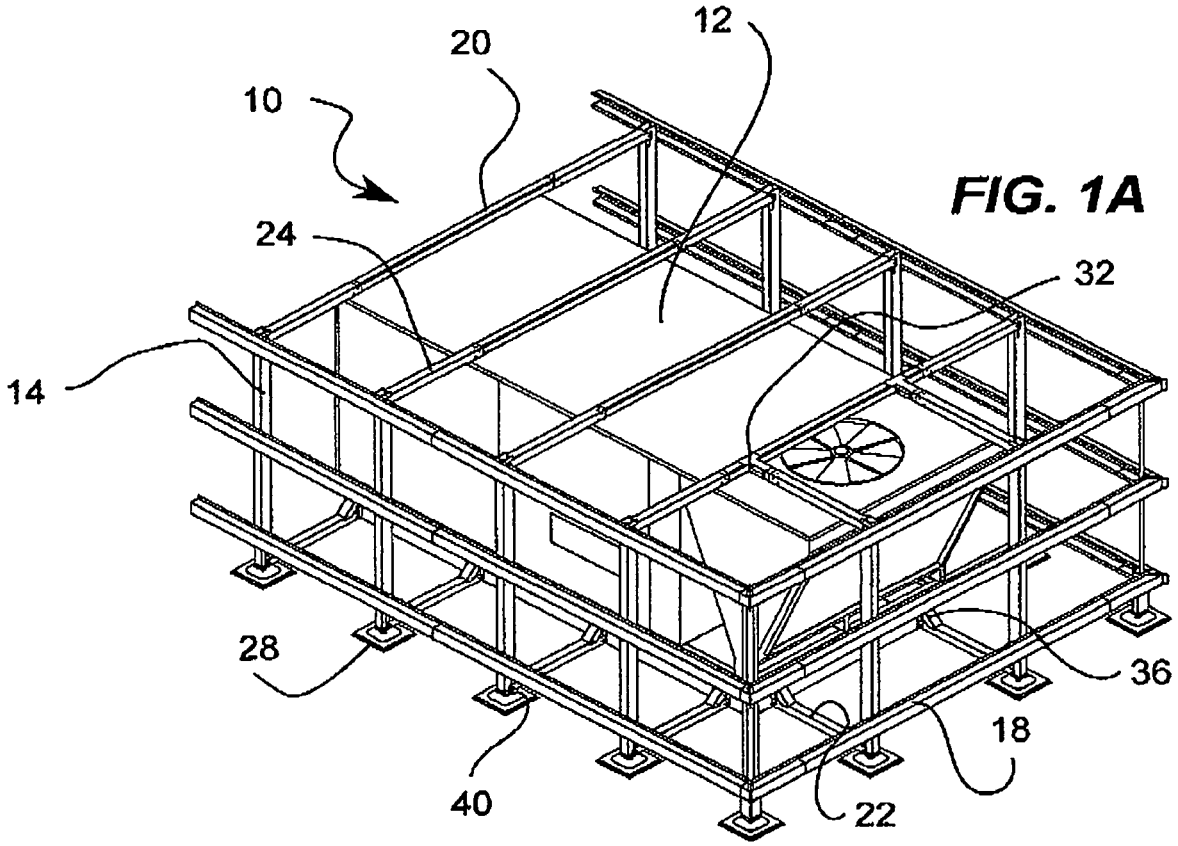
FIG. 1A
FIG. 1B
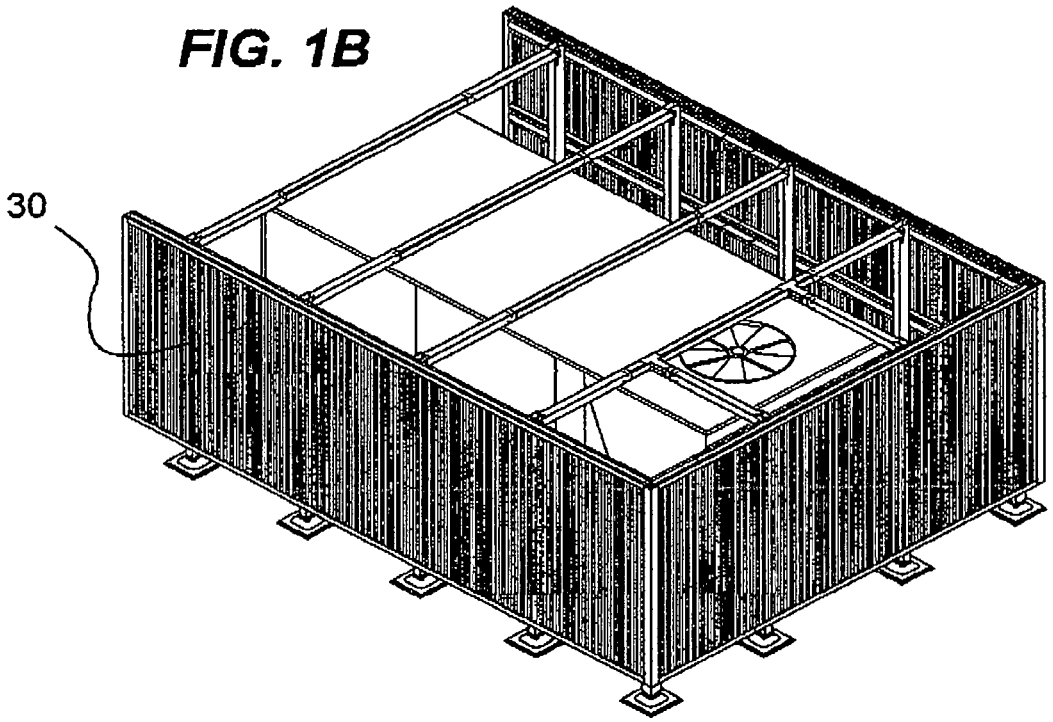

PRIOR ART
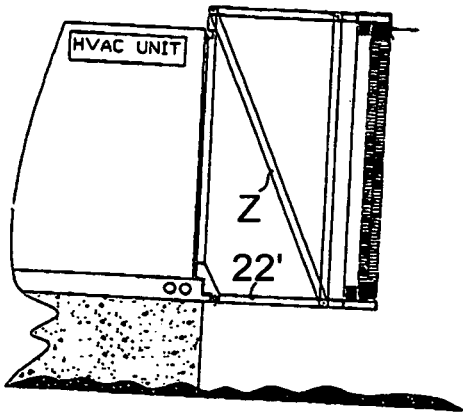
FIG. 2B
PRIOR ART
FIG. 2C
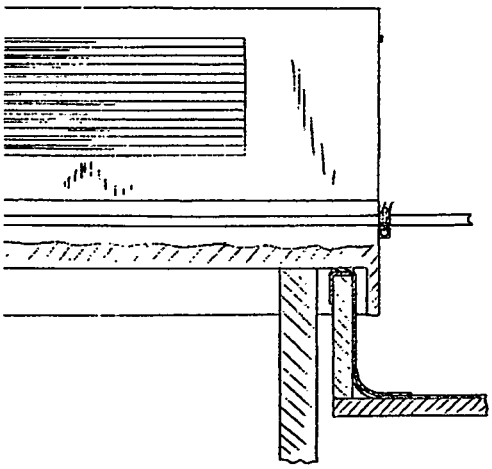

PRIOR ART
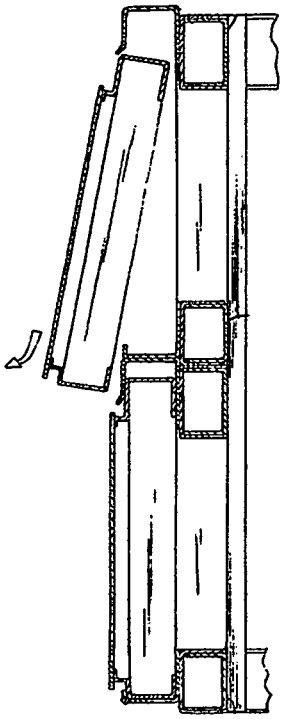
FIG. 2D
FIG. 2E
PRIOR ART
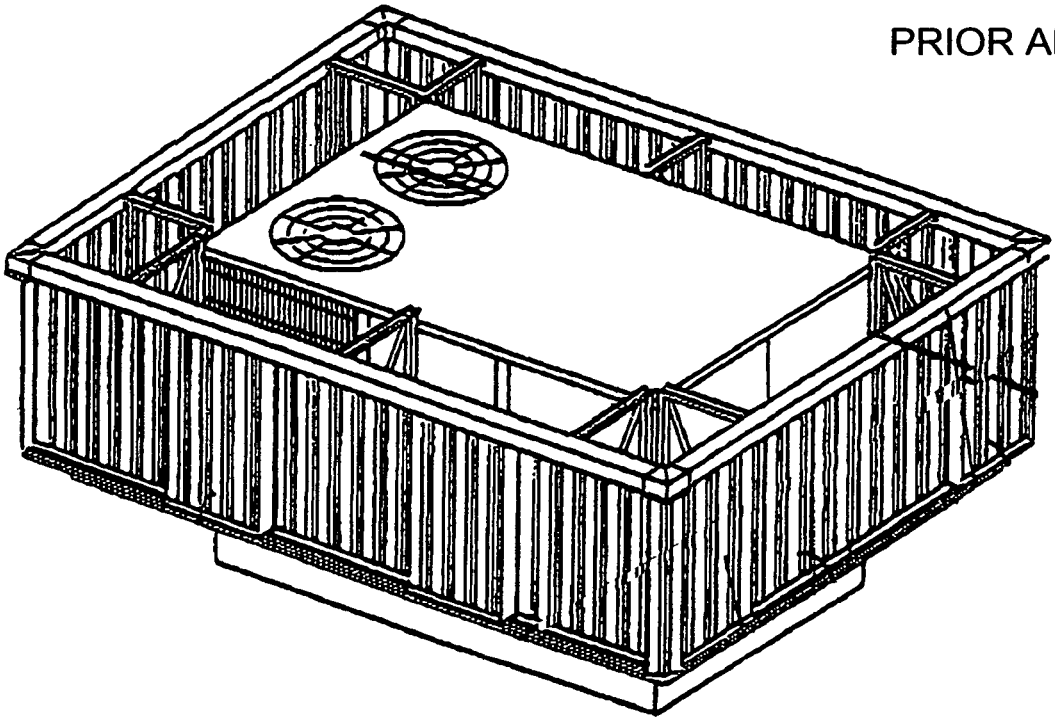

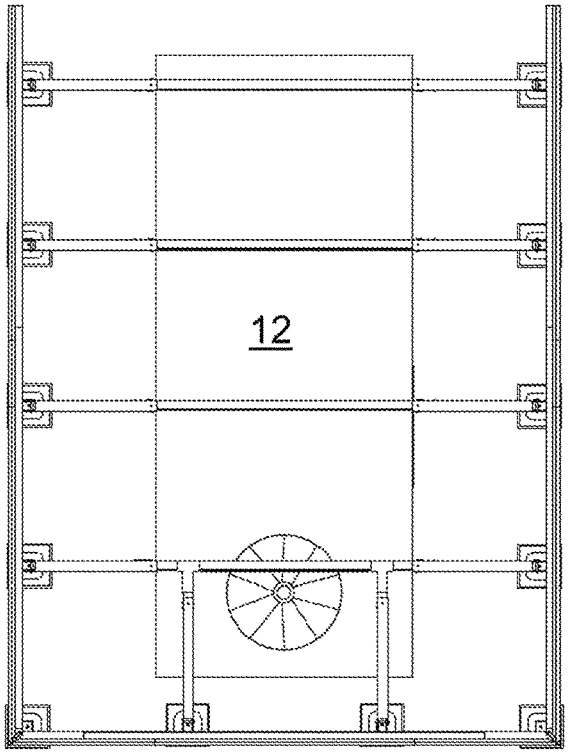
FIG. 8A
FIG. 8B
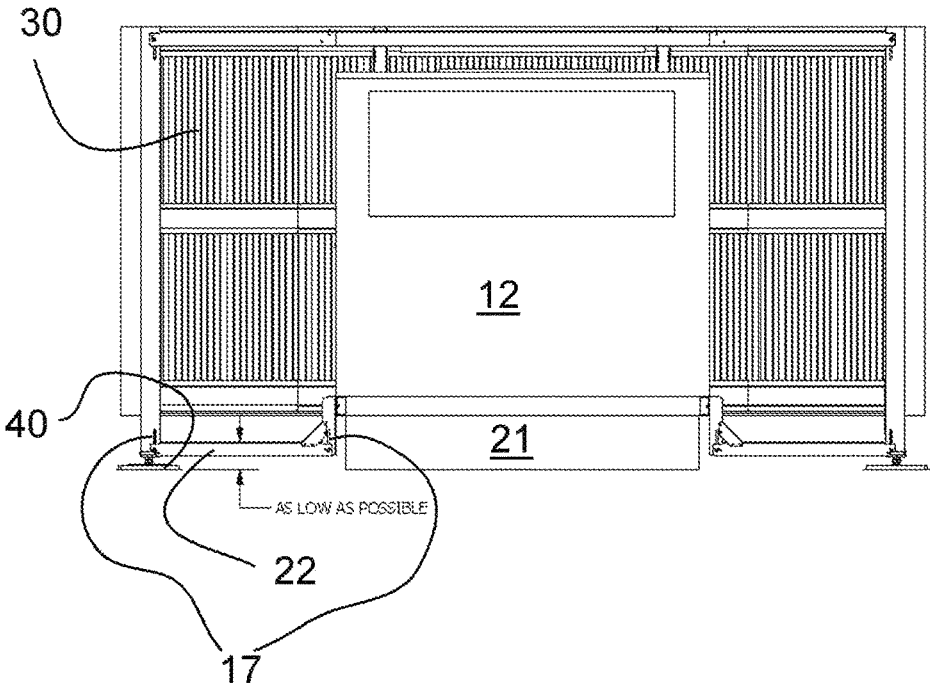

FIG. 9A
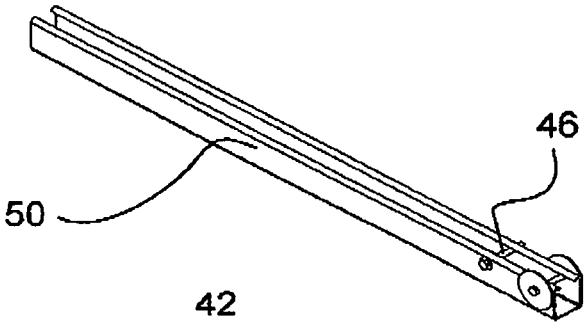
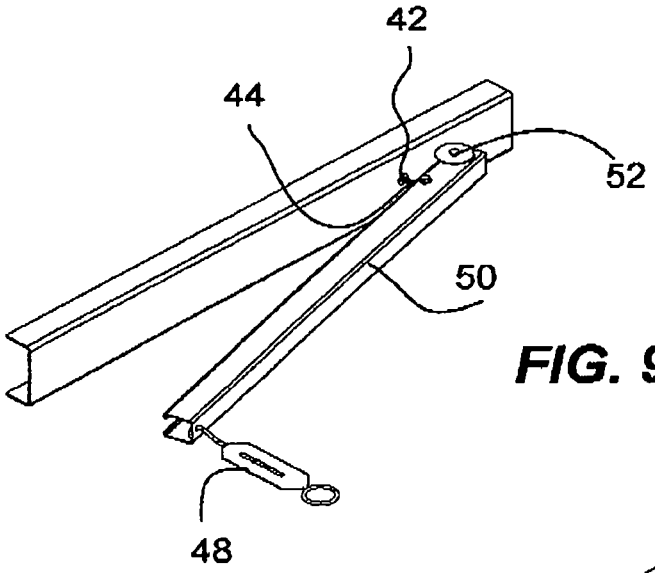
FIG. 9B
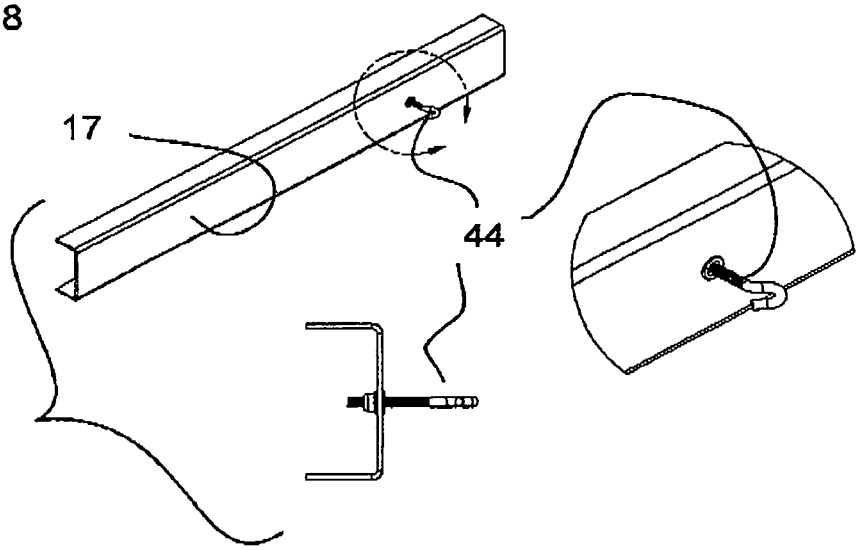
FIG. 9C

FIG. 13A
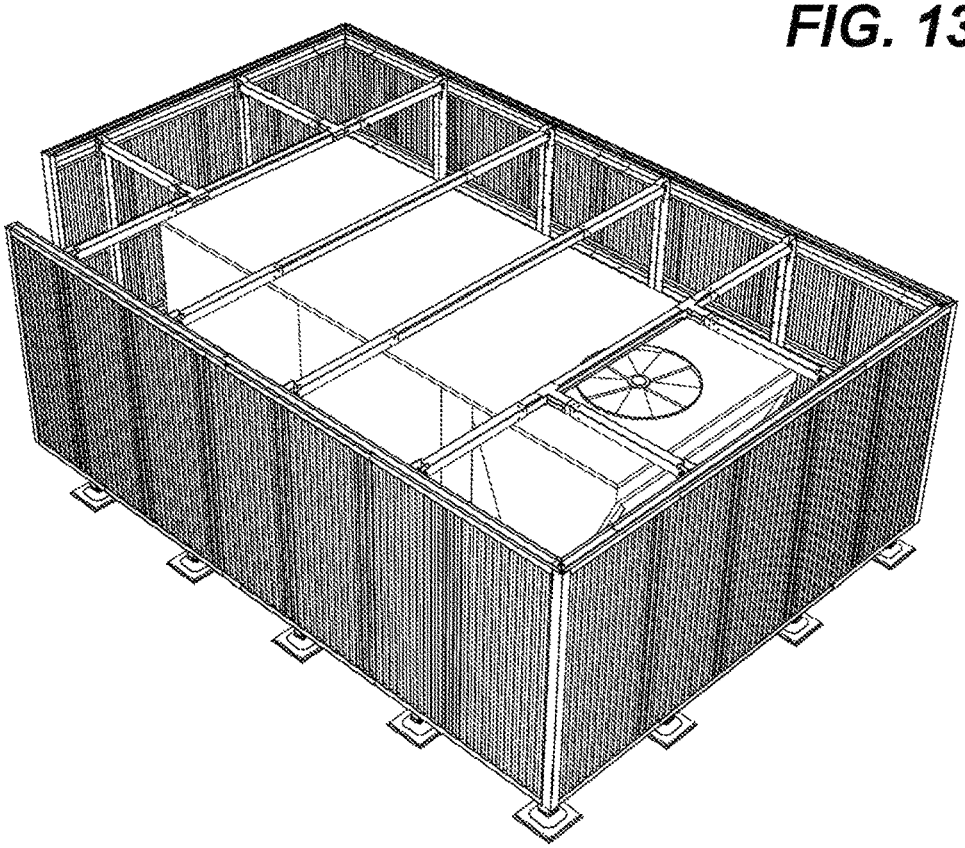
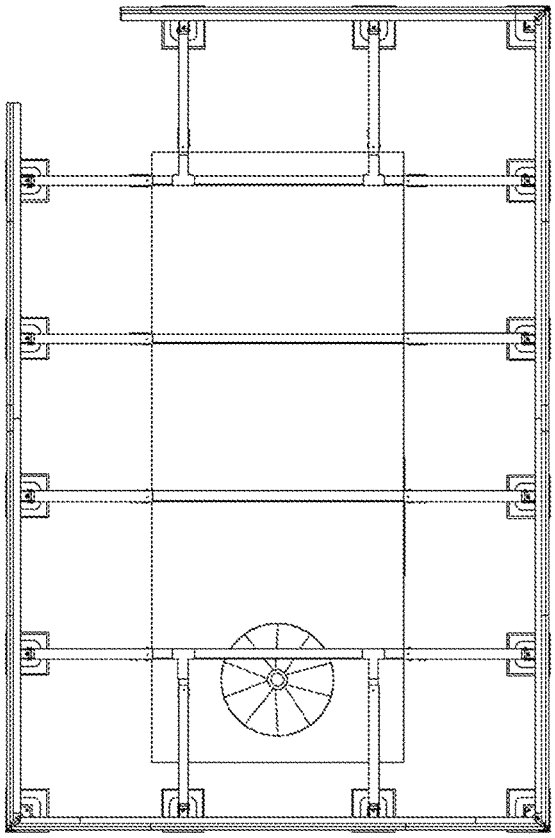
FIG. 13B

STRUCTURE FOR HIDING AND PROTECTING FROM DAMAGE HVAC AND OTHER ROOFTOP MECHANICAL EQUIPMENT

CROSS-REFERENCE TO RELATED APPLICATIONS

The present application is a Continuation In Part claiming priority on patent application Ser. No. 16/265,998, filed on Feb. 2, 2019 entitled "STRUCTURE FOR HIDING AND HVAC AND OTHER ROOFTOP MECHANICAL EQUIPMENT", the disclosure of which is hereby incorporated in its entirety at least by reference.

BACKGROUND OF THE INVENTION

1. Field of the Invention

The present invention relates generally to structures and construction but more particularly to a structure for hiding and protecting from damage HVAC and other rooftop mechanical equipment.

2. Description of Related Art

On large commercial buildings HVAC and related mechanical equipment can be found on the roof. In some instances, during the design phase, architects may incorporate some decorative elements designed for hiding such equipment from view. Recently, some municipalities have amended their building codes so that it makes it mandatory for buildings to hide such equipment. This new rule applies to new and existing buildings. This means that existing buildings have to be retrofitted with some kind of structure having some aesthetic values. In both cases, installing a structure for hiding rooftop mechanical equipment is not always an easy task. First, trying to install a new structure on a rooftop without adversely affecting the roof surface is a challenge, as one does not want a leaky roof as a result of having installed such a structure. Also, a roof is not always level because rainwater drainage requires a slope, which adds a level of difficulty when trying to build a level structure. The added structure must not be too heavy so as to add weight beyond what the building was designed for. The mechanical equipment should not bear the load of the structure. For example in FIG. 2A a heat pump has a perimeter fence with brackets that are mechanically fastened to the top of the heat pump.

This is likely to void any manufacturer warranty. This may not be important for some residential homeowners but applying the teachings of this patent onto commercial HVAC equipment would also void any warranty and not be at all recommended.

Because HVAC equipment needs to exchange air, it cannot be sequestered into a closed structure, there has to be an opening for air exchange and since the purpose of the structure is to hide the equipment, the only way to have an opening is from the top. So, without a roof, and without the possibility of attaching the four walls of the structure to the equipment, how can one make sure that the structure will not be blown by the wind? The installer of such structure cannot drill holes into the roof and cannot use the HVAC as anchoring means. Options are quite limited and thus far, the prior art has not found a solution that provides for a securely attached decorative structure. A decorative structure that can withstand strong wind, and a decorative structure that does not impede the ingress and egress of air flow in and around the HVAC equipment so that it works properly.

Finally, special openings and access ways must be provided so that maintenance can be done unimpeded by accessing the equipment from the outside as well as getting inside the structure so as to also be able to walk around and service various parts of the equipment. No adaptive structural system that can provide such features exists. Consequently, there is therefore room for improvement in that area.

BRIEF SUMMARY OF THE INVENTION

In one aspect of the invention a structure for hiding and protecting from damage HVAC and other rooftop mechanical equipment is provided, comprising a plurality of pre-cut, adjustable metallic frame and support members essentially consisting of vertical support members, horizontal frame members, top frame members, and bottom retaining members, wherein the plurality of pre-cut, adjustable metallic frame and support members are configured to surround the rooftop equipment while providing a passageway enabling a user to provide maintenance on the rooftop equipment. Each bottom retaining member is comprised of a base portion, a reinforcement member, and a connecting member wherein the connecting member is mechanically fastened either to an existing roof curb forming part of the building the structure is on or to a base portion of the rooftop equipment.

In a preferred embodiment, the top frame members are extendible in length via extensions, wherein the extensions are configured and sized to slide and engage with the top frame members.

In yet another preferred embodiment, the connecting member take the wind pressure coming onto the bottom of one side of the screen and transfers it from the screen onto the bottom retaining member, and wind pressure applied to the upper half of the screen is transferred by way of the top frame members onto the vertical support members located on the opposite side of the structure, from there, the force follows the vertical support members downwardly until the forces are transferred via the base portion and reinforcement member onto the bottom retaining member.

The structure for hiding rooftop equipment of claim 1, wherein the plurality of pre-cut, adjustable metallic frame and support members are extruded or cold formed from a selected metallic material in a shape selected from the group consisting of: square, rectangular, "Omega" or "C" shaped.

In yet another preferred embodiment, the extensions may be locked in place with fasteners via a plurality of aligned openings provided on the extensions and the top frame members.

In still another preferred embodiment, each vertical support members rest on a pancake configured to spread the load eliminating potential roof damage.

In another embodiment, the vertical support and vertical frame members include hooks enabling the installation of a screen, wherein the screen is configured to hide the roof equipment.

Such a raised platform forms part of the building and is made specifically to add a layer over the rooftop so that mechanically fastening the HVAC equipment does not damage the roof. But the side of this raised platform, which, like the rest of the raised platform, or the bottom of the HVAC structure, is designed for securely holding mechanical fasteners, allows for the bottom retaining member to be securely fastened. The webbing section forming part of the retaining member allows for forces, such as wind pressure, to be transferred from the vertical walls of the structure perpendicularly onto the retaining member.

Moreover, wind pressure applied to the upper half of the walls is transferred by way of top transfer beams onto the other vertical members forming part of the wall on the opposite side and the forces follow the vertical beam downwardly until the forces are transferred via the base portion onto the retaining member. The weight of the structure is not borne by the HVAC but rather by footings resting on the rooftop. The footings have their load spread over a wide area by way of pancakes having a rubberized underside and resting on top of a membrane made out of the same material as the roof membrane. This ensures that there is no damage to the roof and that it can also bear the load.

Additionally these footings not only have the advantage of distributing the weight of the screen on the roof, they also allow the screen to be level with the building. In most cases, roofs have a slope and the ventilation units are installed according to this roof slope. It is not uncommon to have a 3-4 inch difference between one side of a unit and the other side.

Access to the inside existing screens has always been a challenge. Most of the time, you must either remove a louver, as seen in FIG. 2C, or slide panels as in FIG. 2D. In both cases, a service person must always step over a steel or aluminum bar which is located approximately 2 feet from the ground. In addition, in Nordic countries, ice forms in the mechanism and this blocks the opening of doors. Since in most cases the four sides of an HVAC system do not need to be hidden, we have developed a screen that allows to have a full opening on the back or on the side. In addition, if the four sides must be bidden, we have developed a hinge door so that it does not get caught in the ice.

In one embodiment, wherein the plurality of pre-cut, adjustable metallic frame and support members are extruded or cold formed from a selected metallic material in a shape selected from the group consisting of square, rectangular, or "C" shaped. In one embodiment, top frame members are extendible in length via extensions, wherein the extensions are configured and sized to slide and engage with the top frame members. In another embodiment, the extensions may be locked in place with fasteners via a plurality of aligned openings provided on the extensions and the top frame members. In yet another embodiment, each vertical support members rest on a pancake configured to spread the load eliminating potential roof damage. In one embodiment, the vertical support and vertical frame members include hooks enabling the installation of a screen, wherein the screen is configured to hide the roof equipment.

It should be noted that the term HVAC is to be interpreted as to mean any rooftop equipment that needs to be hidden. HVAC is just used here as a shorthand rather than a limitation.

BRIEF DESCRIPTION OF THE SEVERAL VIEWS OF THE DRAWINGS

Other features and advantages of the present invention will become apparent when the following detailed description is read in conjunction with the accompanying drawings, in which:

FIGS. 1A-B is an isometric view of a structure for hiding HVAC and other rooftop mechanical equipment according to an embodiment of the present invention.

FIGS. 2A-E are side views of structures from the prior art.

FIG. 8A is a top view of a mechanical equipment component with the structure installed around it element according to an embodiment of the present invention.

FIG. 8B is a side view of a mechanical equipment component, platform, and bottom retaining member according to embodiment of the present invention.

FIGS. 9A-C are various isometric views of a lever component according to an embodiment of the present invention.

FIG. 13A-B are isometric and a top view, respectively, showing the full side corner access way.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a structure for hiding HVAC and other rooftop mechanical equipment.

Figure 6:
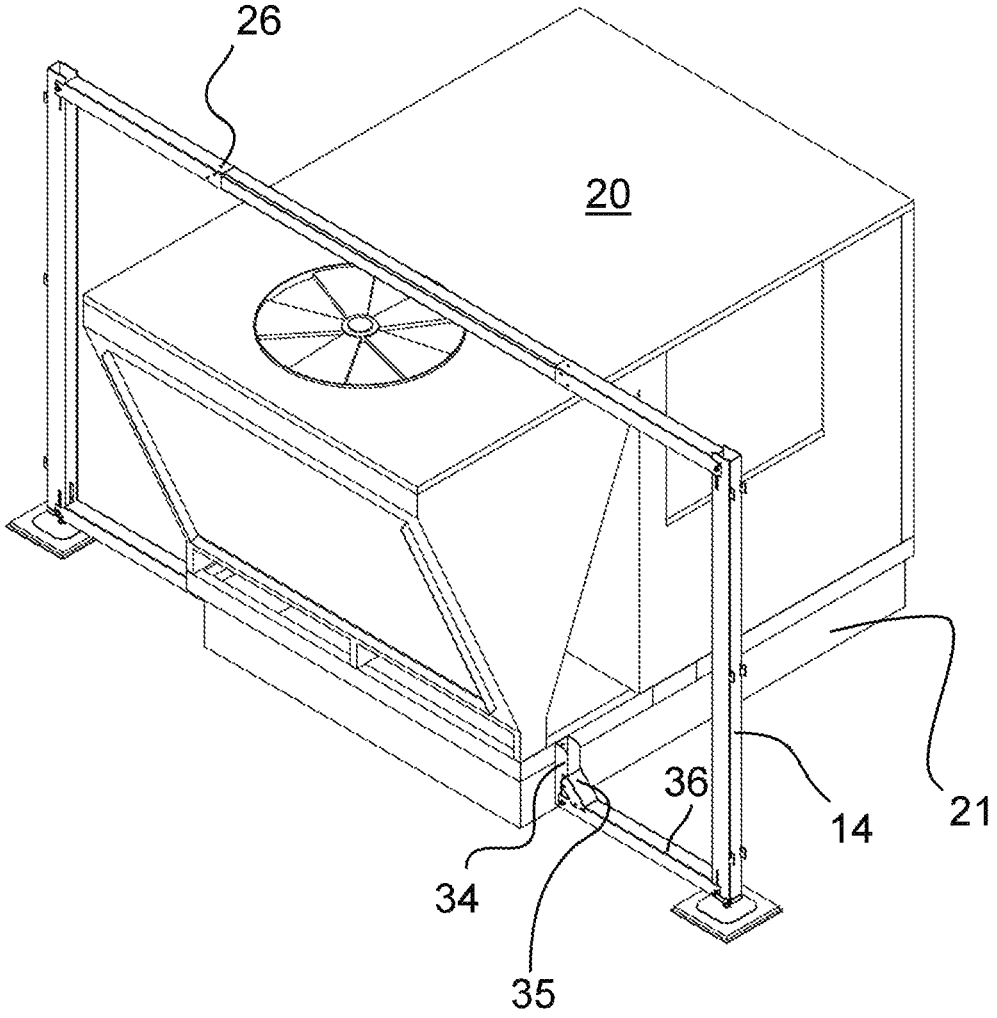
FIG. 6 is an isometric view showing how the webbing sections attach to the raised platform or the bottom of the HVAC structure.
Figure 7A:
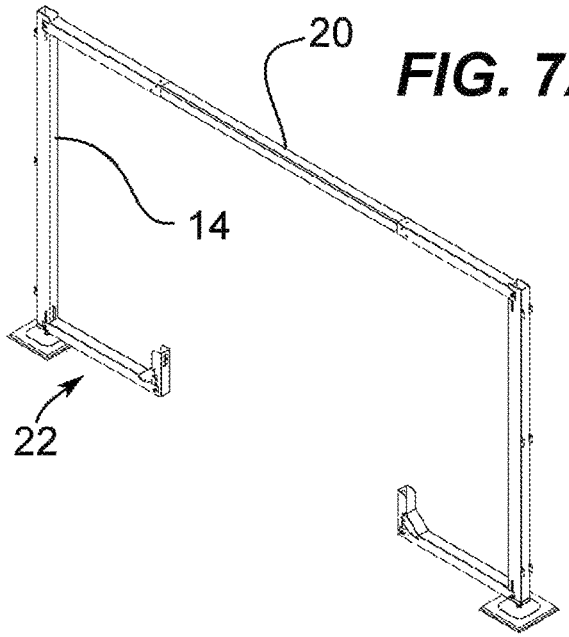
FIGS. 7A-C are isometric views of various components for the structure for hiding HVAC and other rooftop mechanical equipment according to an embodiment of the present invention.
Figure 7B:
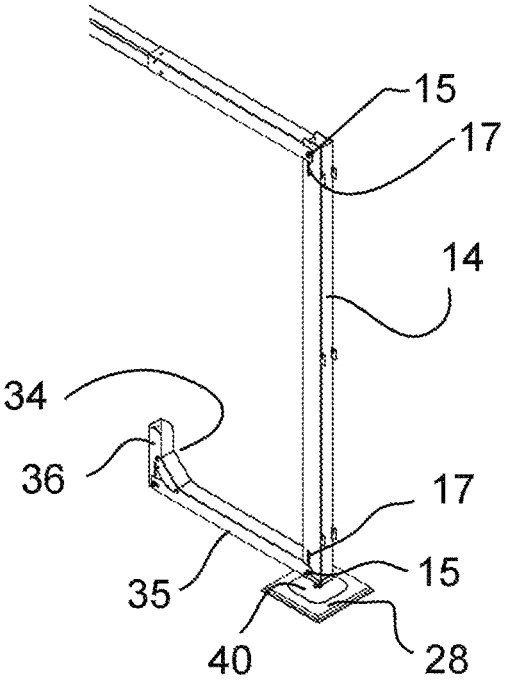
Figure 7C:
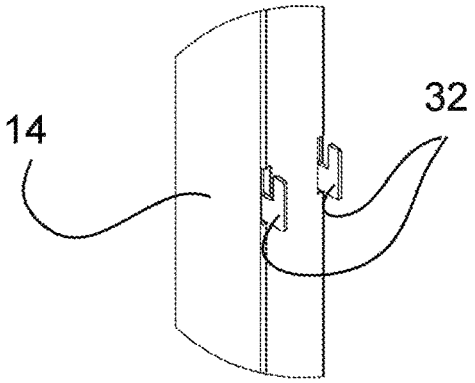

Referring now more particularly to FIGS. 1,6 and 7, a structure 10 for hiding HVAC 12 and other rooftop mechanical equipment is illustrated. In one embodiment, the structure comprises a plurality of vertical support members 14, horizontal frame members 18, top frame members 20, and bottom retaining members 22. In a preferred embodiment, the frame and support members previously mentioned are pre-cut, adjustable, and constructed from a metallic material, such as aluminum, galvanized steel, or any other suitable material. The frame and support members are extruded or cold formed from the selected material in a shape such as, square, rectangular, "Omega" or "C" shaped.

Figure 2A:
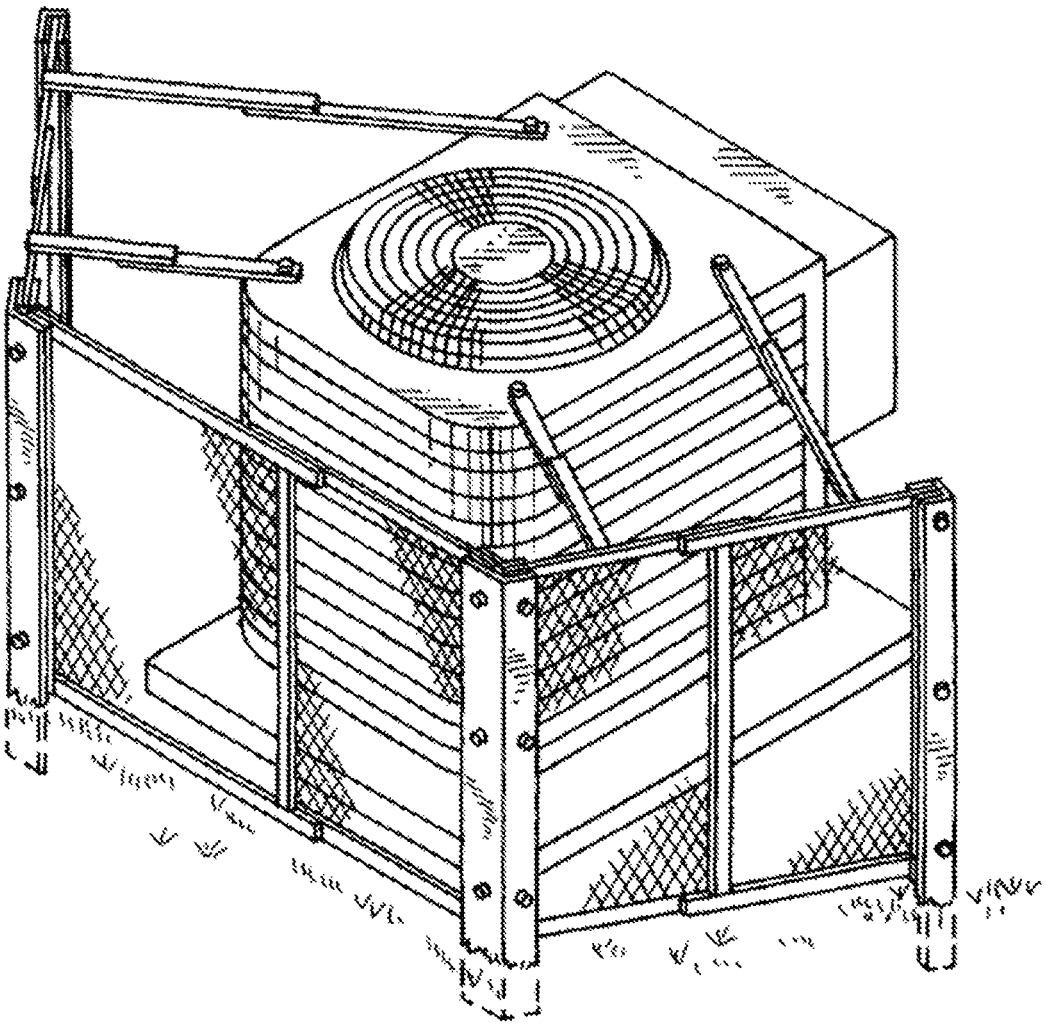
PRIOR ART FIG. 2A
Figure 11:
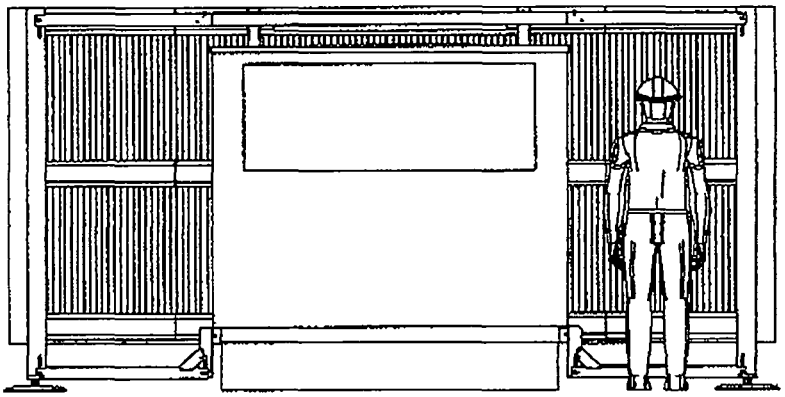
FIG. 11 is a view showing a people accessing around the HVAC.

In one embodiment, the frame and support members are size, shaped, and joined such that the HVAC and rooftop mechanical equipment is surrounded, yet still providing access around the equipment such that maintenance workers can perform any necessary maintained on the equipment when needed. The challenge with this type of design is that generally, structures of this type would require diagonal braces for structural strength. However, diagonal braces as seen in the prior art of FIG. 2B diagonal Z blocks the access way to the equipment. The provided access and unencumbered passageway around the equipment is a particular advantage of the present invention. As seen in FIG. 11, the bottom retaining member 22 is at no more than 8 inches above the rooftop whereas in FIG. 2B, which is an example of the prior art, an equivalent bottom retaining member 22' is anywhere between 18.24 inches above the rooftop. This greatly encumbers the process of entering inside the structure for servicing. To provide the necessary structure and support, the bottom retaining members 22 are further comprised of a base portion 34, a reinforcement member 35, and a connecting member 36.

In one embodiment, the top frame members 20 are extendible in length via extensions 24, which are configured and sized to slide and engage with the top frame members 20. In one embodiment, the extension are locked in place using metal screws that pass through holes (typically two aligned on each side and one on top) made into the extension 24 and piercing through the top frame member 20. The bottom retaining members 22 and top frame members 20 connect with the vertical support members 14 by way of pins 15 passing through grooves 17 as illustrated in FIG. 7B. In one embodiment, the top frame members 20 connect to other top frame members 20 via connecting brackets 32, as seen in FIG. 1A. In one embodiment, the vertical support members 14 with their footings 40 rest on the pancakes 28 configured for spreading the load to eliminate potential roof damage.

Figure 10:
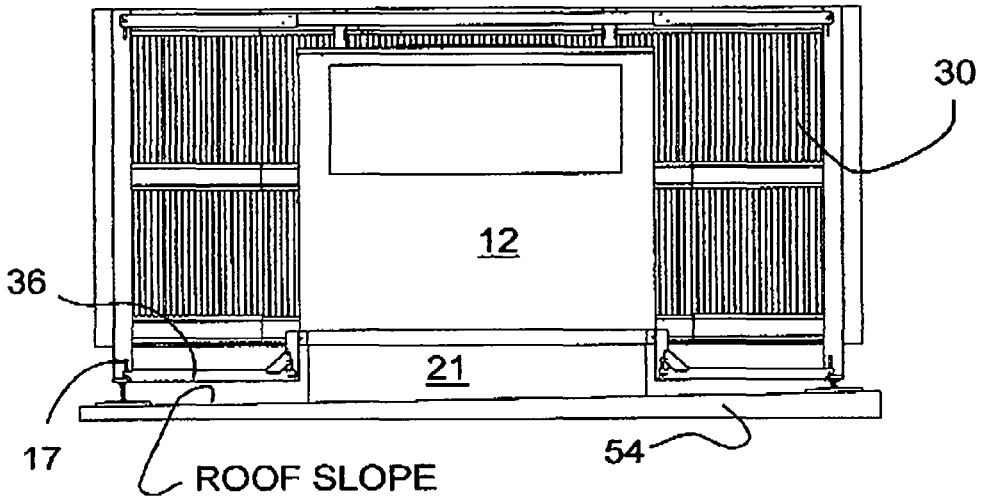
FIG. 10 is a side view showing how to leveling the hiding system.

In order to set a screen 30 level in relation to a building rather than the slope of a rooftop 54, as seen in FIGS. 8B and 10, the base portions 22 are installed so that they follow the building rather than the slope of the rooftop 54 level with the building. In order to do that, one needs to simply use the groove 17 so that the footing 40 can rest firmly on the rooftop 54.

Figure 5:
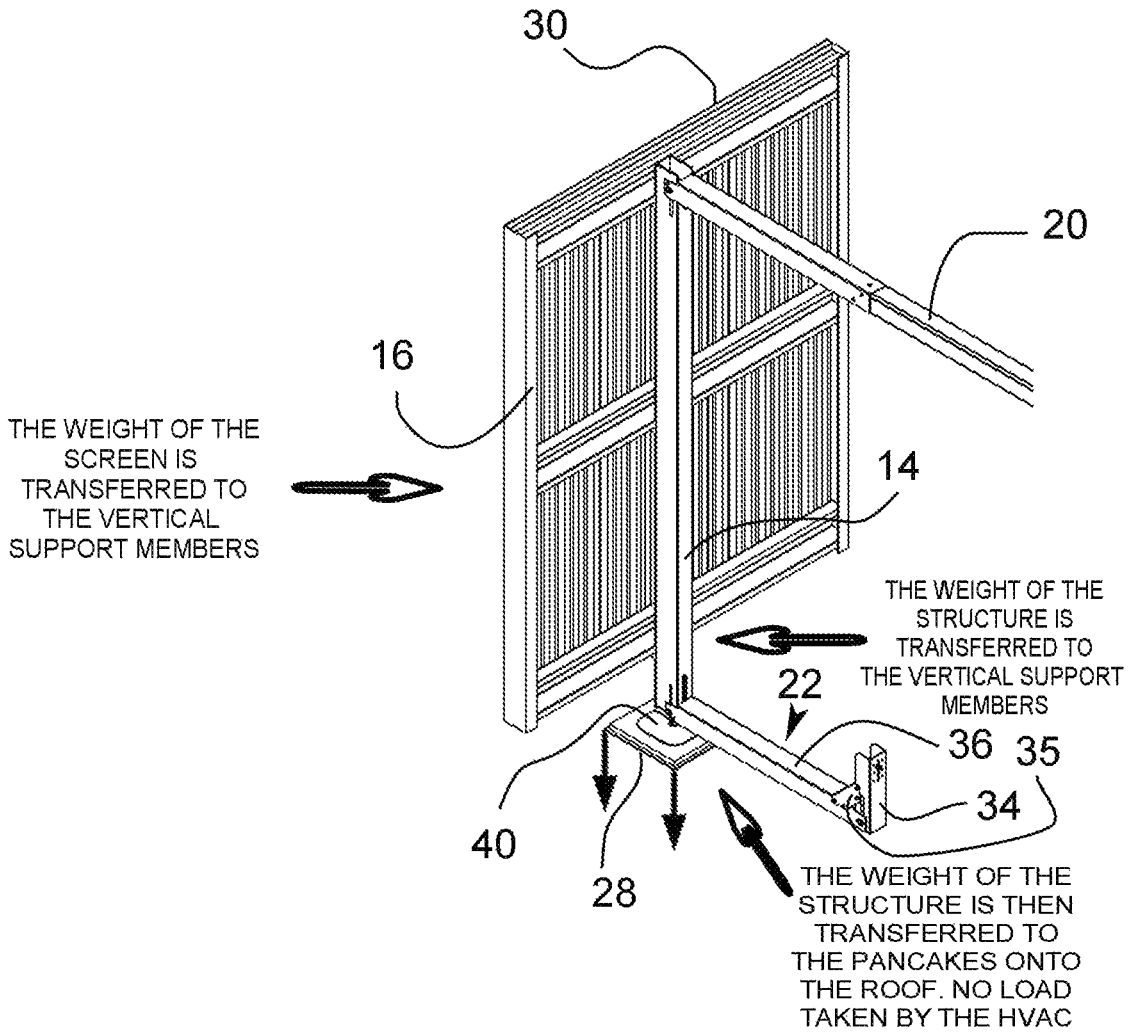
FIG. 5 is an isometric view of the vertical frame members, top frame members, screen, and bottom retaining members, showing how the forces are applied and transferred.

In one embodiment, hooks 32 are provided on the vertical support members 14, enabling the installation of the screen 30 (best seen in FIG. 5), wherein the screen 30 provides a means for hiding the HVAC. Latches (not illustrated) may be provided on the screen 30 to engage with the hooks 32.

Figure 12A:
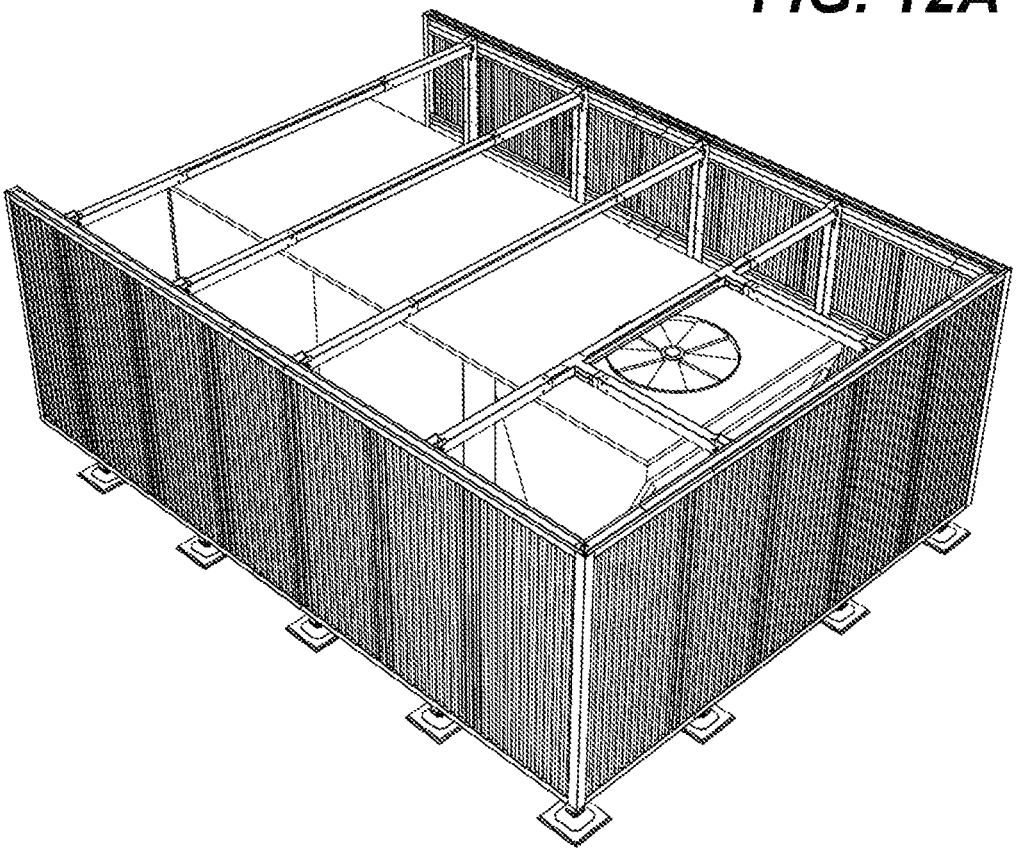
FIG. 12A-B are isometric and a top view, respectively, showing the full rear access way.
Figure 12B:
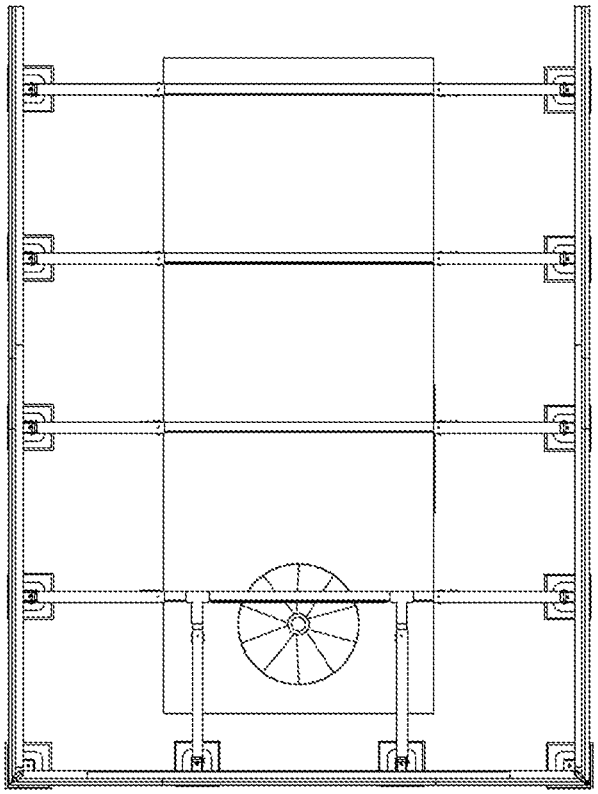

There are three ways that a service person can access to the inside of the screen:

1) As seen in FIG. 12, one side of the screen open.

2) One corner is left open as per FIG. 13.

Figure 14A:
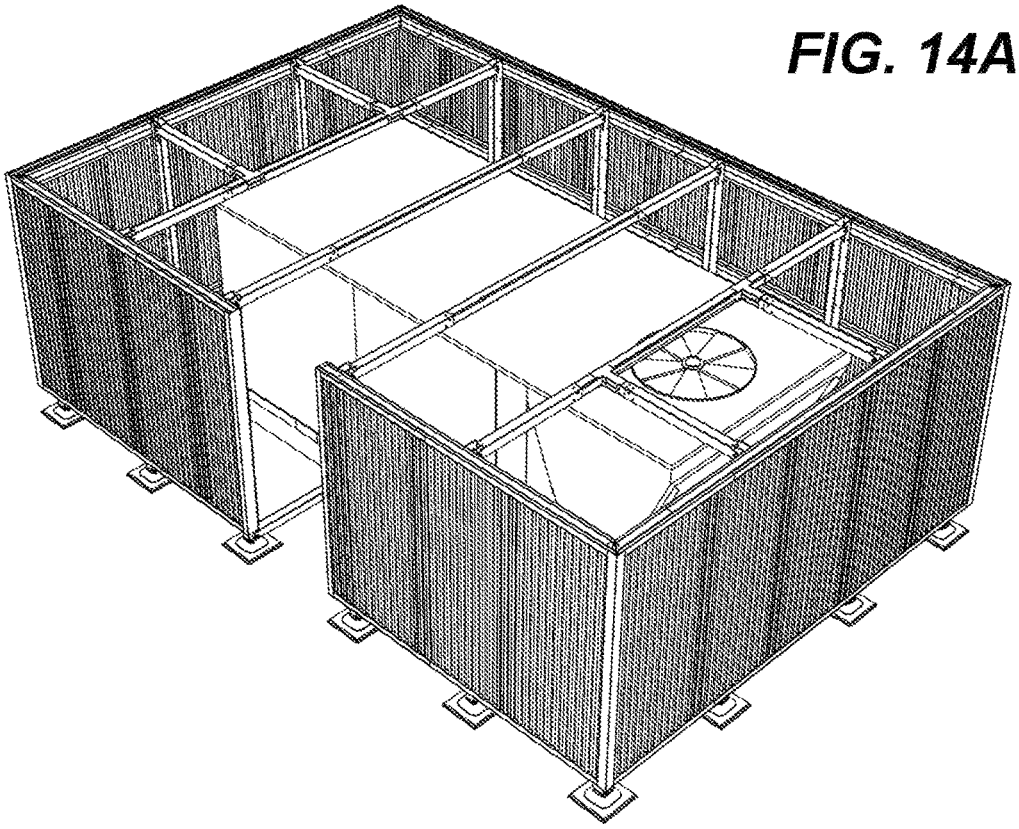
FIG. 14A-B are isometric and a top view, respectively, showing the full side access way.
Figure 14B:
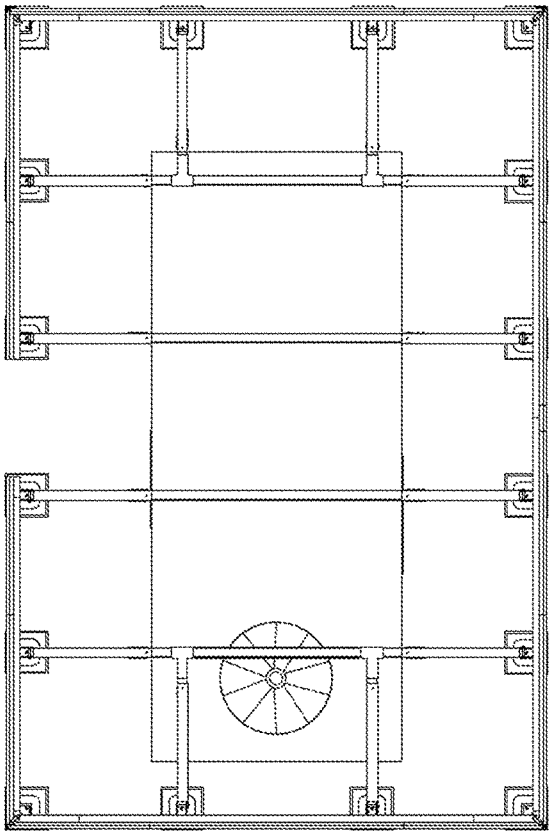
Figure 15A:
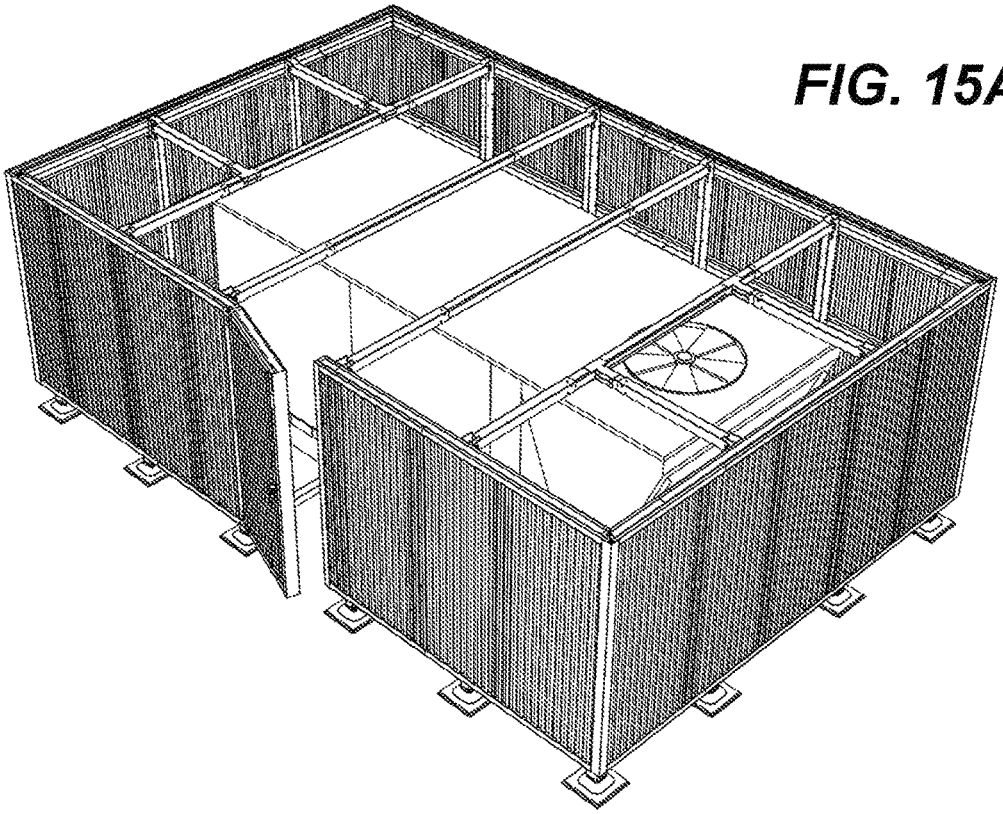
FIG. 15A-B are isometric and a top view, respectively, showing the full side access way with a door.
Figure 15B:
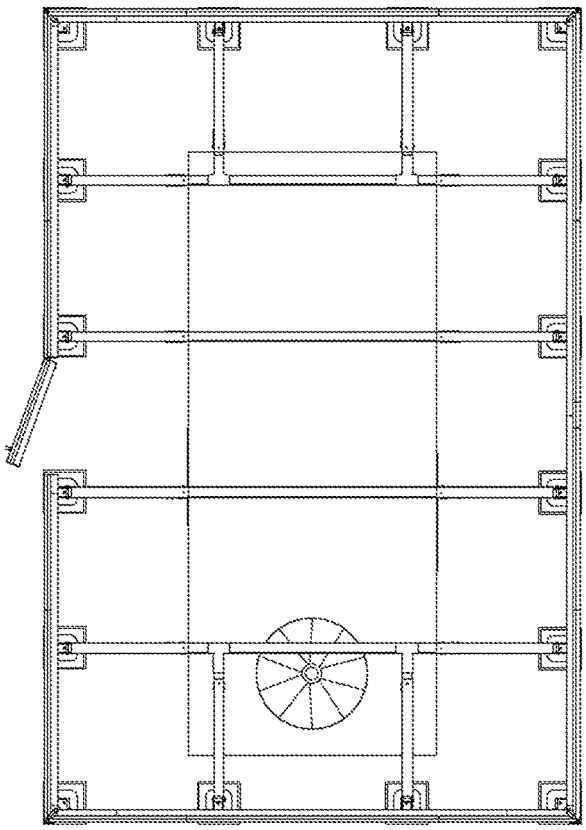

3) There is a door on one of the walls as per FIG. 14.

No matter which way is used, access is always easy.

Figure 16:
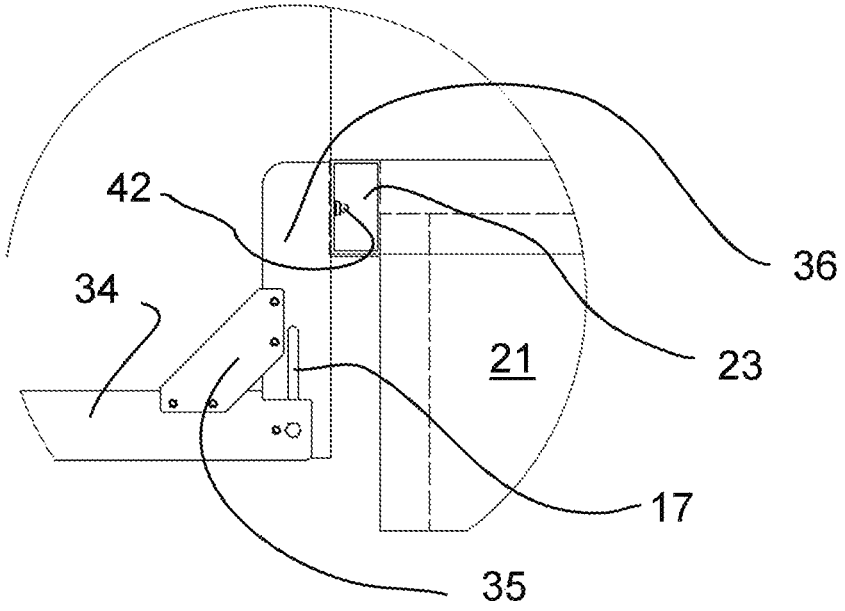
FIG. 16 is the typical installation on the bottom of the HVAC structure.
Figure 17A:
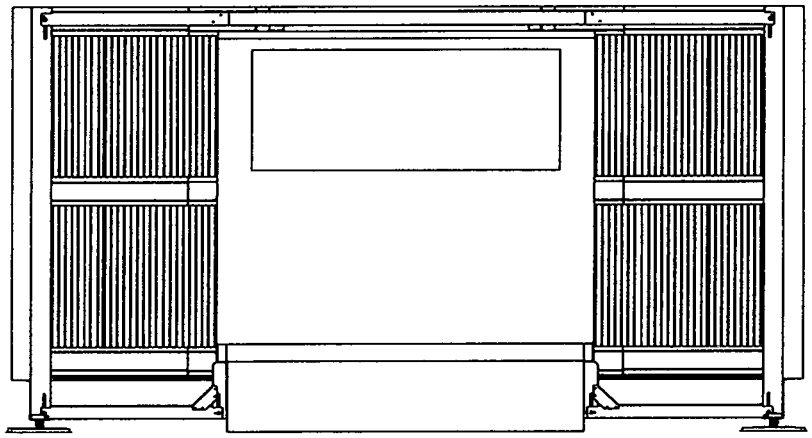
FIG. 17A-B are side view and side view detail, respectively, showing the typical installation on top of the raised platform.
Figure 17B:
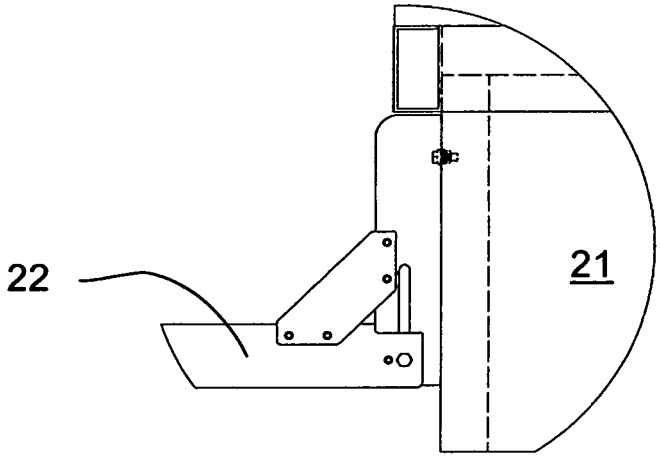

In a preferred embodiment, the structure is not secured directly to the roof, but rather by utilizing the existing roof curb 21, best seen in FIG. 17 or a bottom section of the HVAC structure, as best seen in FIG. 16, when the HVAC manufacturer has provided its equipment with a bottom portion specifically for this function (In other words, no warranty violation). In this manner, no drilling into the roof is required but rather on the side of the roof curb 21 as seen in FIG. 17B, or to a bottom portion 23 of the HVAC structure FIG. 16.

As best seen in FIGS. 9A-C, these methods comprise steps (a) drilling holes through on the side of the raised platform or the bottom of the HVAC structure; (b) inserting threaded inserts 42 into the drilled holes; (c) squeezing the threaded inserts so that they bulge in such a way that they cannot be pulled out from the roof curb 21 or the bottom of the HVAC structure; (d) testing the strength of the insertion by partially screwing in a bolt 44 so as to let room for hooking the head of the bolt with a rod member 46 forming part of a lever 50; and (e) hooking a hanging weighing scale 48 at a distal end of the lever 50, and using a fulcrum part 52 of the lever pressed against the roof curb 21 or the bottom of the HVAC structure, pulling on the lever 50 so as to exert a pre-determined pulling force on the bolt 44, as measured by the scale 48, a way of testing the quality of the insertion of the threaded insert into the roof curb 21 or the bottom of the HVAC structure.

This validation ensures that the roof curb 21 or the bottom of the HVAC structure can bear any environmental load, such as wind applied to the structure. If the test is successful, bolt 44 is removed and bottom retaining member 22 is installed and the bolt with a washer is bolted in. Once the bottom retaining member 22 is installed, the rest of the structure may be assembled.

Such a roof curb 21 forms part of the building and is made specifically to add a layer over the roof top so that mechanically fastening the HVAC equipment will not damage the roof. But the side of this roof curb 21, which, like the rest of the roof curb 21 or the bottom of the HVAC structure are designed for securely holding mechanical fasteners, allows for the bottom retaining member 22 to be securely fastened. The connecting member 36 allows for forces, such as wind pressure, to be transferred from the screen 30 of the structure perpendicularly onto the bottom retaining member 22. Moreover, wind pressure applied to the upper half of the screen 30 is transferred by way of top frame members 20 onto the other vertical support members 14 forming part of the wall on the opposite side and the forces follow the vertical support members 14 downwardly until the forces are transferred via the base portion 34 and reinforcement member 35 onto the bottom retaining member 36. The weight of the structure is not borne by the HVAC but rather by footings 40 resting on the rooftop. The footings 40 have their load spread over a wide area by way of pancakes 28 having a rubberized underside and resting on top of a membrane made out of the same material as the roof membrane. This ensures that there is no damage to the roof 54 and that it can also bear the load.

Figure 3A:
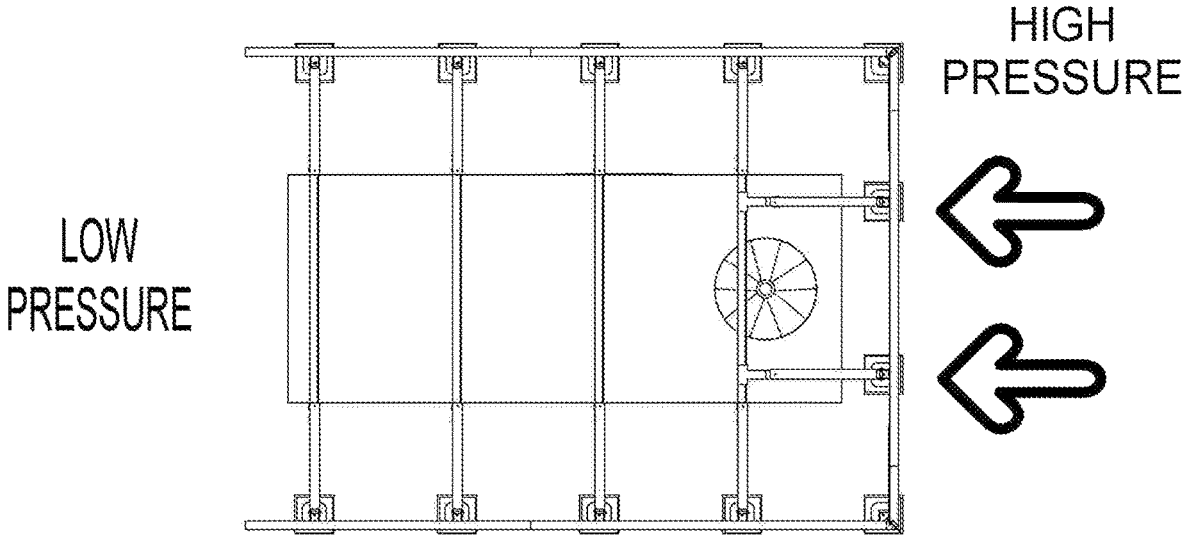
FIGS. 3A-B are top views of the structure showing wind direction.
Figure 3B:
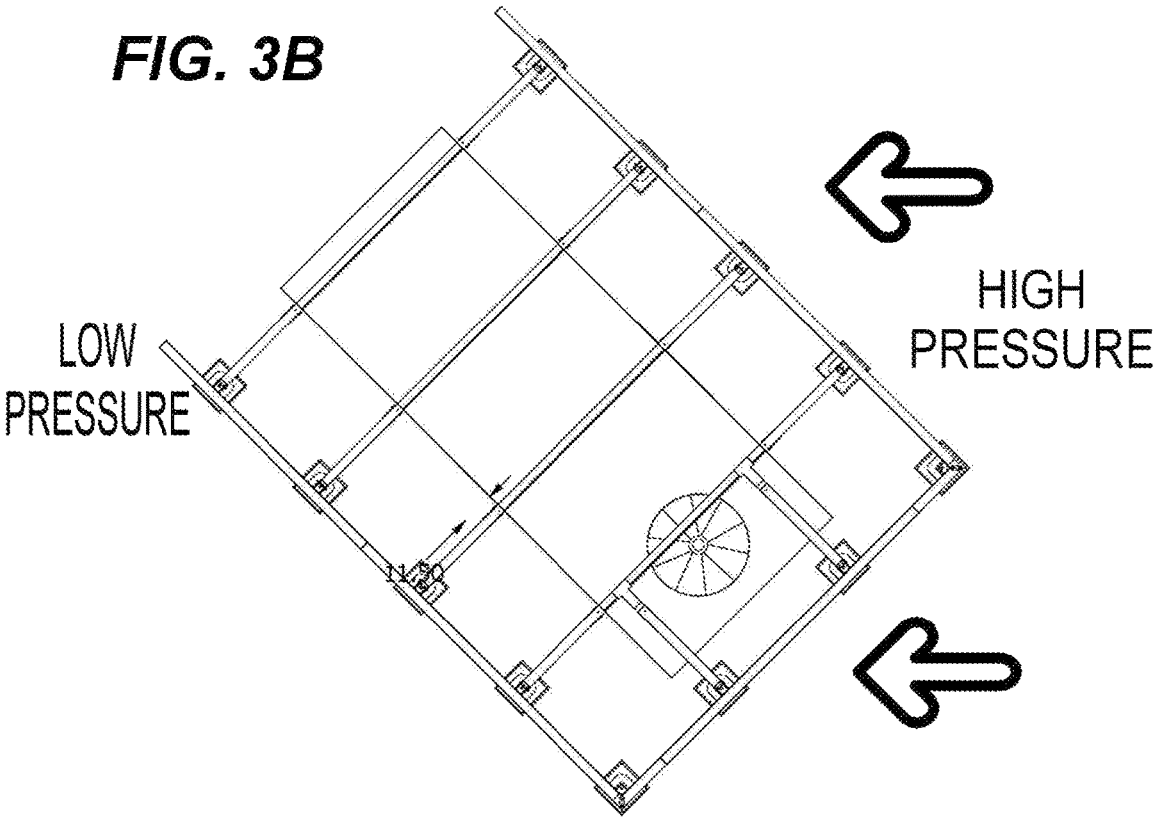
Figure 4:
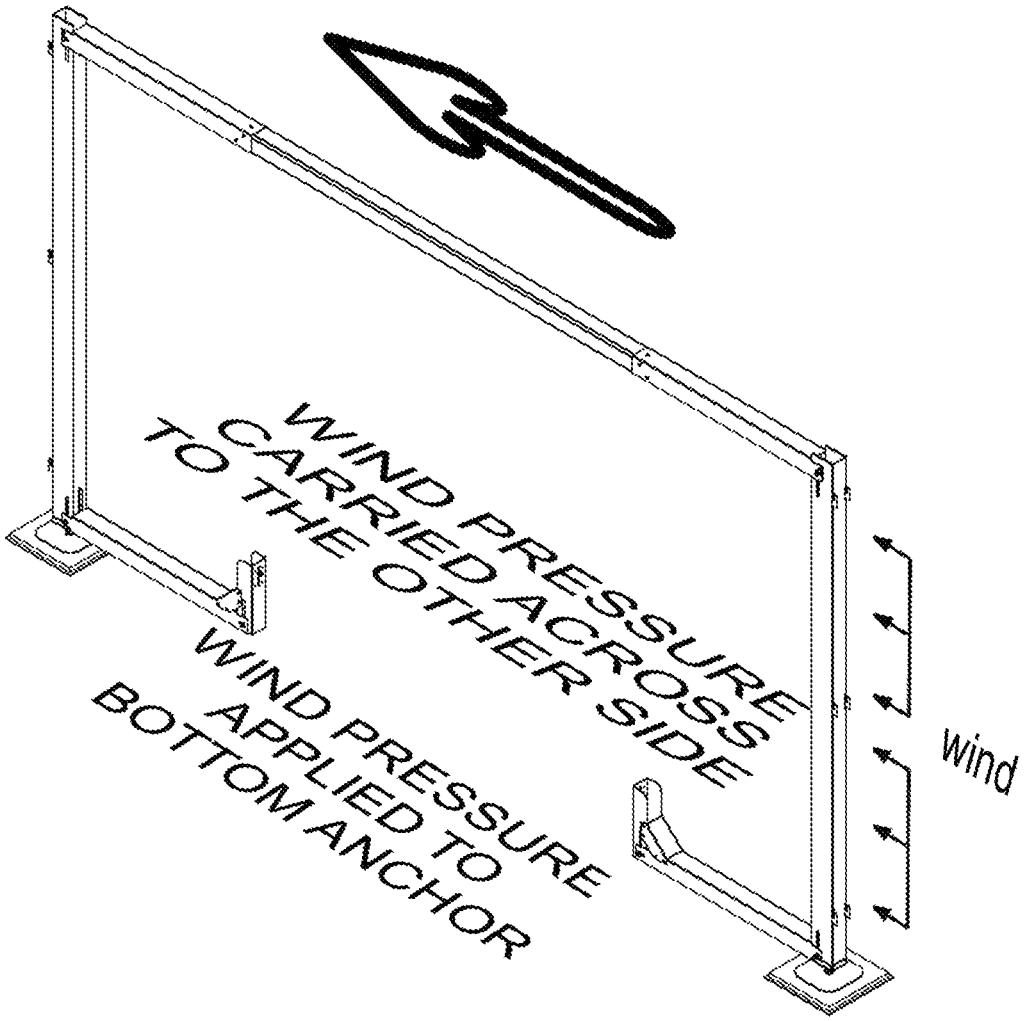
FIG. 4 is an isometric view showing how the loads are distributed.

This transfer of forces from one side to the other, and down to the bottom retaining members 22, as best seen in FIGS. 3A-B and 4, ensures that the structure is solid and secured around the HVAC equipment.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A structure for hiding and protecting from damage rooftop equipment comprising:

a plurality of pre-cut, adjustable metallic frame and support members essentially consisting of vertical support members, horizontal frame members, top frame members, and bottom retaining members, wherein the plurality of pre-cut, adjustable metallic frame and support members are configured to surround the rooftop equipment while providing a passageway enabling a user to provide maintenance on the rooftop equipment; and, each bottom retaining member is comprised of a base portion, a reinforcement member, and a connecting member wherein the connecting member is mechanically fastened either to an existing roof curb forming part of the building the structure is on or to a base portion of the rooftop equipment; the connecting member take wind pressure coming onto the bottom of one side of a screen and transfers it from the screen onto the bottom retaining member; and wind pressure applied to an upper half of the screen is transferred by way of the top frame members onto the vertical support members located on the opposite side of the structure, from there, a force follows the vertical support members downwardly until the forces are transferred via the base portion and reinforcement member onto the bottom retaining member.

2. The structure for hiding rooftop equipment of claim 1, wherein the top frame members are extendible in length via extensions, wherein the extensions are configured and sized to slide and engage with the top frame members.

3. The structure for hiding rooftop equipment of claim 1, wherein the plurality of pre-cut, adjustable metallic frame and support members are extruded or cold formed from a selected metallic material in a shape selected from the group consisting of: square, rectangular, "Omega" or "C" shaped.

4. The structure for hiding rooftop equipment of claim 3, wherein the extensions may be locked in place with fasteners via a plurality of aligned openings provided on the extensions and the top frame members.

5. The structure for biding rooftop equipment of claim 1, wherein each vertical support members rest on a pancake configured to spread the load eliminating potential roof damage.

6. The structure for hiding rooftop equipment of claim 1, wherein the vertical support and vertical frame members include hooks enabling the installation of a screen, wherein the screen is configured to bide the roof equipment.

* * * * *